US007621689B2

(12) United States Patent
Nishioka et al.

(10) Patent No.: US 7,621,689 B2
(45) Date of Patent: Nov. 24, 2009

(54) ATTACHMENT COUPLER

(75) Inventors: Takao Nishioka, Kaga (JP); Yoshihiro Moto, Komatsu (JP)

(73) Assignee: Kabushiki Kaisha Muroto Tekkosho (JP)

( * ) Notice: Subject to any disclaimer, the term of this patent is extended or adjusted under 35 U.S.C. 154(b) by 0 days.

(21) Appl. No.: 12/074,220

(22) Filed: Feb. 29, 2008

(65) Prior Publication Data

US 2009/0129858 A1 May 21, 2009

(30) Foreign Application Priority Data

Nov. 21, 2007 (JP) ..... 2007-302207

(51) Int. Cl.
*B25G 3/18* (2006.01)
*F16B 21/00* (2006.01)
*F16D 1/00* (2006.01)

(52) U.S. Cl. ..... 403/322.1; 403/321; 403/322.4; 403/325; 37/468; 37/903; 414/723

(58) Field of Classification Search ..... 403/315, 403/321, 322.1, 322.3, 325, 331, 322.4, 330; 37/403, 468, 903; 172/272; 414/705, 723
See application file for complete search history.

(56) References Cited

U.S. PATENT DOCUMENTS 5,125,788 A * 6/1992 Stenger ..... 414/723
5,546,683 A * 8/1996 Clark ..... 37/468
5,549,440 A * 8/1996 Cholakon et al. ..... 414/723
6,231,296 B1 * 5/2001 Blomgren ..... 414/723
6,241,455 B1 * 6/2001 Schupback et al. ..... 414/723
6,308,442 B1 * 10/2001 Naka et al. ..... 414/723
6,422,805 B1 * 7/2002 Miller ..... 37/468
6,431,785 B1 * 8/2002 Melander ..... 414/723
6,625,909 B1 * 9/2003 Miller et al. ..... 37/468
7,014,385 B2 * 3/2006 Lim et al. ..... 403/322.4
2002/0136597 A1 9/2002 Nishikawa et al.

FOREIGN PATENT DOCUMENTS

JP 2001-288770 10/2001

* cited by examiner

*Primary Examiner*—Daniel P Stodola
*Assistant Examiner*—Nahid Amiri
(74) *Attorney, Agent, or Firm*—Harness, Dickey & Pierce, P.L.C.

(57) ABSTRACT

An attachment coupler is attached to an end of an arm of a working machine. An attachment having two attachment pins in parallel can be detachably attached to the attachment coupler. The attachment coupler includes a first U-shaped portion that engages with and supports one of the attachment pins sideways, and a second U-shaped portion that receives the other attachment pin downwardly. The second U-shaped portion includes a rotary hook that opens and closes the opening of the second U-shaped portion. The rotary hook includes an engagement securing member that engages with and secures the rotary hook when the rotary hook closes the opening of the second U-shaped portion and when the rotary hook opens the opening of the second U-shaped portion, and a bolt securing member that secures the rotary hook with a bolt when the rotary hook closes the opening of the second U-shaped portion.

2 Claims, 6 Drawing Sheets

ATTACHMENT COUPLER

Japanese Patent Application No. 2007-302207 filed on Nov. 21, 2007, is hereby incorporated by reference in its entirety.

BACKGROUND OF THE INVENTION

The present invention relates to a coupler for attaching/detaching or replacing an attachment (e.g., bucket, clamshell bucket, or vibration crusher) secured to the end of an arm of a working machine such as a power shovel.

A working machine (e.g., power shovel) widely used for engineering work must be provided with various attachments (e.g., clamshell bucket or vibration crusher) instead of a bucket depending on the type of work.

In a small-scale construction site, various types of work must be generally performed utilizing a single power shovel. In such construction work, the attachment must be replaced by another attachment each time another type of work is performed.

An attachment coupler has been utilized to easily and quickly perform such a replacement operation.

JP-A-2001-288770 discloses technology in which a coupler includes a movable hook and a stationary hook, and the movable hook is driven and secured using a hydraulic cylinder so that attachment-side connection shafts detachably engage with the hooks. According to this technology, since the coupler must be provided with a hydraulic cylinder reception/operation space, the size of the coupler increases. As a result, the attachment may interfere with a working machine or the like due to an increase in the swing radius of the attachment.

SUMMARY

According to one aspect of the invention, there is provided an attachment coupler that is attached to an end of an arm of a working machine, an attachment having two attachment pins in parallel being detachably attached to the attachment coupler, the attachment coupler comprising:

a first U-shaped portion that engages with and supports one of the two attachment pins sideways; and a second U-shaped portion that has an opening that receives the other of the two attachment pins downwardly, the second U-shaped portion including a rotary hook that opens and closes the opening of the second U-shaped portion; and the rotary hook including:

an engagement securing member that engages with and secures the rotary hook when the rotary hook closes the opening of the second U-shaped portion and when the rotary hook opens the opening of the second U-shaped portion; and a bolt securing member that secures the rotary hook with a bolt when the rotary hook closes the opening of the second U-shaped portion.

DETAILED DESCRIPTION OF THE EMBODIMENT

Figure 1A:
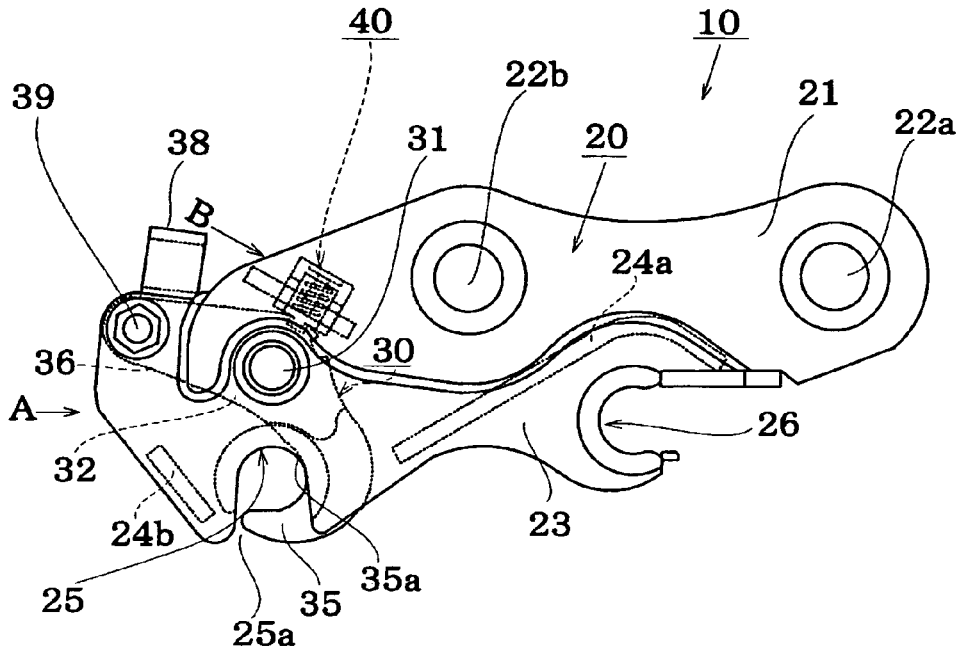
FIG. 1A is an external view showing an attachment coupler according to the invention.

The invention has been conceived in view of the above technical problems. An object of the invention is to provide an attachment coupler which has a simple structure and is effective for reducing the swing radius of an attachment.

According to one embodiment of the invention, there is provided an attachment coupler that is attached to an end of an arm of a working machine, an attachment having two attachment pins in parallel being detachably attached to the attachment coupler, the attachment coupler comprising:

a first U-shaped portion that engages with and supports one of the two attachment pins sideways; and a second U-shaped portion that has an opening that receives the other of the two attachment pins downwardly, the second U-shaped portion including a rotary hook that opens and closes the opening of the second U-shaped portion; and the rotary hook including:

an engagement securing member that engages with and secures the rotary hook when the rotary hook closes the opening of the second U-shaped portion and when the rotary hook opens the opening of the second U-shaped portion; and a bolt securing member that secures the rotary hook with a bolt when the rotary hook closes the opening of the second U-shaped portion.

The term "second U-shaped portion" refers to a U-shaped cut portion formed by cutting a base body inward when viewed along the axial direction of the attachment pin. The side of the attachment pin can be inserted into the opening of the U-shaped portion and received by the U-shaped portion.

The rotary hook interferes with the path through which the attachment pin falls from the second U-shaped portion at a position at which the rotary hook closes the opening of the second U-shaped portion to secure the attachment pin to the second U-shaped portion. The rotary hook does not interfere with the path through which the attachment pin falls from the second U-shaped portion at a position at which the rotary hook opens the opening of the second U-shaped portion so that the attachment pin can be freely inserted into or removed from the second U-shaped portion.

Therefore, it suffices that the rotary hook be a member which protrudes into the opening of the second U-shaped portion when viewed along the axial direction of the attachment pin at a position at which the rotary hook closes the second U-shaped portion, and withdraws from the opening of the second U-shaped portion at a position at which the rotary hook opens the second U-shaped portion.

As the bolt securing member, a bolt may be inserted into bolt holes formed in the rotary hook and the base body when the rotary hook is situated at a position at which the rotary hook closes the opening of the second U-shaped portion, and the rotary hook and the base body may be fastened with the bolt, for example.

In the attachment coupler, the engagement securing member may include:

a lock lever tool that is spring-biased to protrude toward the rotary hook; and locking depressions that are formed in the rotary hook, the lock lever tool engaging with one of the locking depressions when the rotary hook closes the opening of the second U-shaped portion, and engaging with the other of the locking depressions when the rotary hook opens the opening of the second U-shaped portion.

In the attachment coupler, the lock lever tool may include a first operation lever that is used to release the engagement of the lock lever tool with the rotary hook against a spring biasing force of the lock lever tool;

the rotary hook may include a guide portion, an end of a second operation lever that is used to rotationally move the rotary hook being inserted into the guide portion; and the rotary hook may be rotationally moved by a vertical operation of the second operation lever while releasing the engagement of the lock lever tool with the rotary hook by inserting the end of the second operation lever into the guide portion and moving the second operation lever against the spring biasing force of the lock lever tool.

In the attachment coupler according to this embodiment of the invention, when working with a working machine provided with the attachment, the attachment pin is reliably secured to the second U-shaped portion by fastening the rotary hook with a bolt. The bolt is removed when detaching the attachment or replacing the attachment by another attachment, and the rotary hook is simply secured using the engagement means that can be released by operating the second lever. This makes it unnecessary to provide a large space and parts for a hydraulic cylinder, whereby the thickness of the attachment coupler in the swing radius direction can be reduced.

Therefore, the swing radius of the attachment secured to the attachment coupler can be reduced, whereby a situation in which the attachment interferes with the working machine or the like can be prevented.

The rotary hook can be easily moved rotationally by means of leverage by inserting the second operation lever into the guide portion.

Embodiments of an attachment coupler according to one aspect of the invention are described below with reference to the drawings.

Figure 3A:
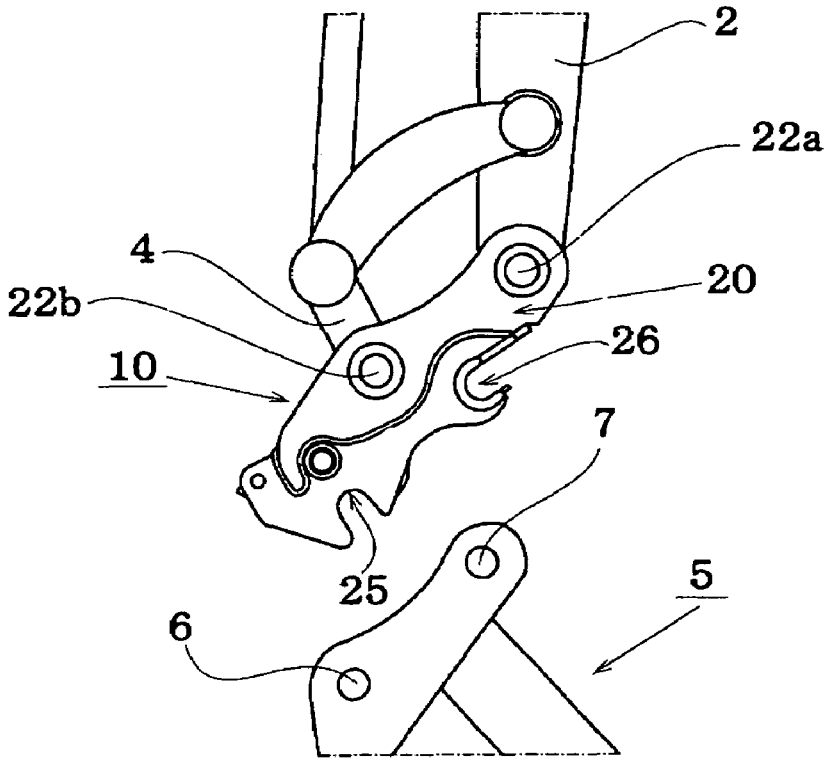
FIG. 3A shows a state before securing an attachment to a coupler attached to the end of an arm of a working machine.

FIG. 1A is an external view showing an attachment coupler (hereinafter simply referred to as "coupler") 10 according to the invention. FIG. 3A shows a state before securing an attachment 5 to the coupler 10 attached to the end of an arm of a working machine, and FIG. 3B shows a state in which the attachment 5 is secured to the coupler 10.

Figure 2A:
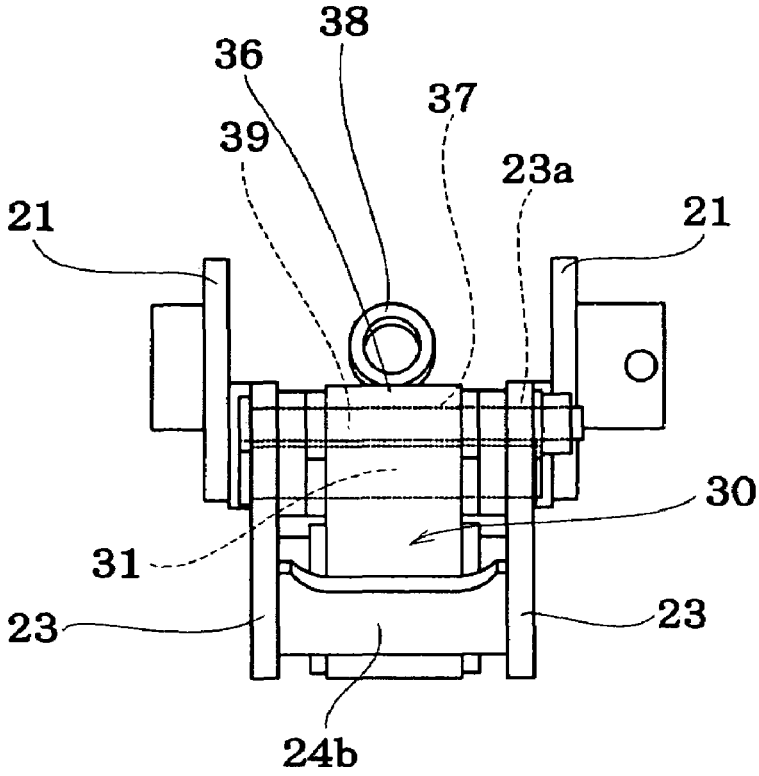
FIG. 2A is a view illustrative of the main portion viewed along a direction indicated by an arrow A in FIG. 1A.
Figure 2B:
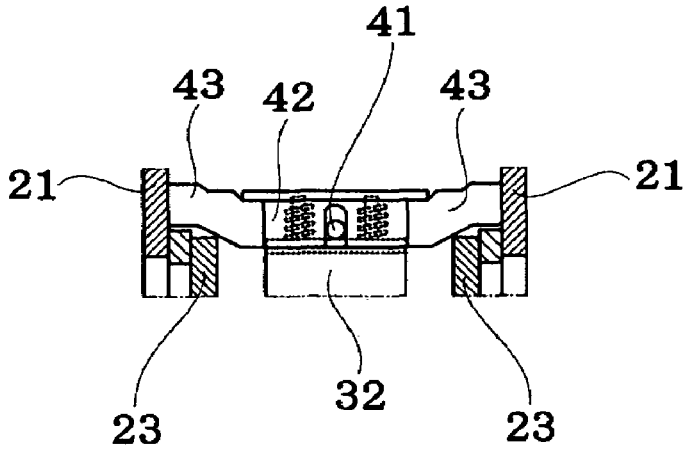
FIG. 2B is a view illustrative of the main portion viewed along a direction indicated by an arrow B in FIG. 1A.

FIG. 2A is a view illustrative of the main portion of the coupler 10 viewed along the direction indicated by an arrow A in FIG. 1A, and FIG. 2B is a view illustrative of the main portion of the coupler 10 viewed along the direction indicated by an arrow B in FIG. 1A.

Figure 3B:
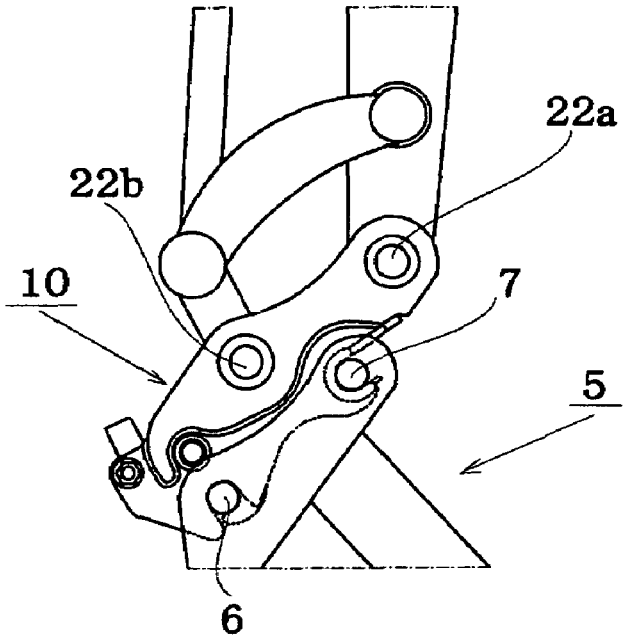
FIG. 3B shows a state in which the attachment is secured to the coupler.

As shown in FIGS. 3A and 3B, the coupler 10 includes a pair of connection pins 22*a* and 22*b* provided at the upper side of a base body 20 and pivotally attached to an arm 2 and a link 4 of a working machine (e.g., power shovel).

The coupler 10 includes, at the lower side of the base body 20, a lock-side U-shaped portion (second U-shaped portion) 25 with a U-shaped cross section which receives an attachment pin 6 of the attachment 5 and opens downward (i.e., toward the attachment 5), and a U-shaped portion (first U-shaped portion) 26 with a U-shaped cross section which receives an attachment pin 7 and opens outward in the direction almost perpendicular to the direction toward the attachment 5.

A rotary hook 30 is provided near the lock-side U-shaped portion 25 of the base body 20 so that the rotary hook 30 rotationally moves to close an opening 25*a* of the lock-side U-shaped portion 25 to prevent removal of the attachment pin 6 inserted into the lock-side U-shaped portion 25.

The rotary hook 30 can be secured using a securing bolt/nut 39 (bolt securing member) at a position at which the rotary hook 30 closes the opening 25*a* of the lock-side U-shaped portion 25.

A lock lever tool 40 is attached to the base body 20 so that the lock lever tool 40 faces the rotary hook 30. The lock lever tool 40 can engage with and secure the rotary hook 30 (i.e., can prevent rotational movement of the rotary hook 30) at a position at which the rotary hook 30 opens the opening 25*a* of the lock-side U-shaped portion 25 and a position at which the rotary hook 30 closes the opening 25*a* of the lock-side U-shaped portion 25, as described later.

Figure 1B:
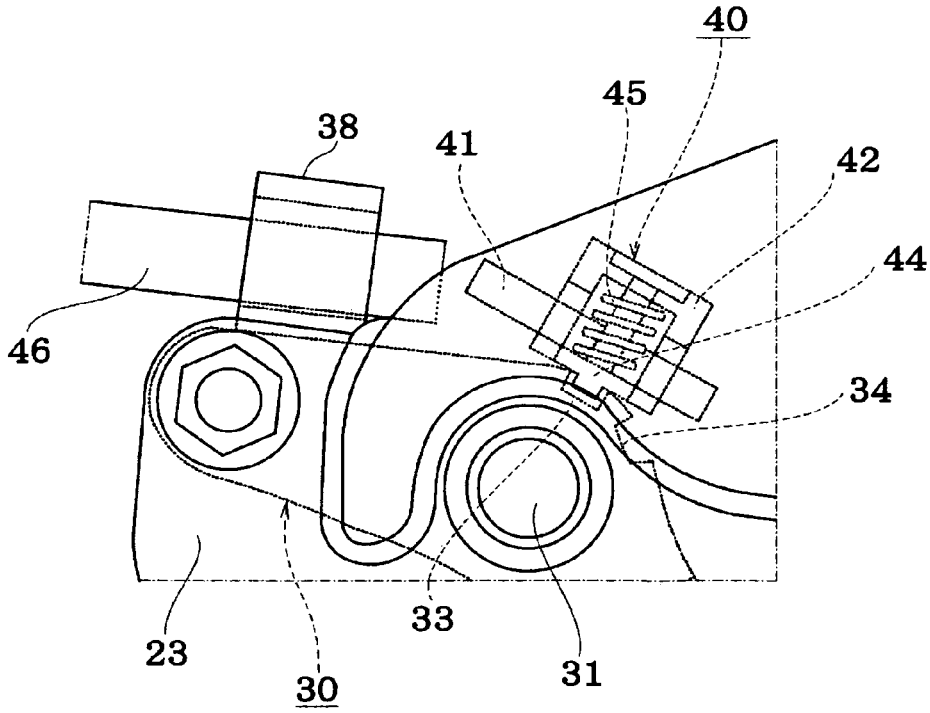
FIG. 1B is an enlarged view showing a portion around a lock lever tool.

FIG. 1B is an enlarged view illustrative of a portion around the lock lever tool 40.

As shown in FIGS. 2A and 2B, the base body 20 includes two opposite mounting plates 21. The pair of connection pins 22*a* and 22*b* is pivotally attached to the opposite portions of the mounting plates 21 (see FIGS. 3A and 3B).

As shown in FIGS. 2A and 2B, a pair of opposite locking plates 23 is respectively connected to the lower portion of the corresponding mounting plate 21 by welding or the like. The locking plates 23 are connected using a first connection plate 24*a* and a second connection plate 24*b* (see FIG. 1A).

The lock-side U-shaped portion 25 and the U-shaped portion 26 are formed by cutting each locking plate 23 inward (from the outside) when viewed along the axial direction of the attachment pins 6 and 7 so that the lock-side U-shaped portion 25 and the U-shaped portion 26 have a grooved U-shaped cross section when viewed along the axial direction of the attachment pins 6 and 7 respectively inserted into the lock-side U-shaped portion 25 and the U-shaped portion 26.

The rotary hook 30 is formed so that a locking pawl 35 extends from a rotary portion 32 having a hook shaft 31 toward the lock-side U-shaped portion 25 and an arm portion 36 extends from the rotary portion 32 on the side opposite to the locking pawl 35. The ends of the hook shaft 31 are pivotally attached to the locking plates 23 between the opposite locking plates 23 so that the rotary hook 30 can freely move rotationally around the hook shaft 31.

The locking pawl 35 is formed to protrude into and close the opening 25*a of* the lock-side U-shaped portion 25 or withdraw from and open the opening 25*a* along with rotational movement of the rotary hook 30 when viewed along the axial direction of the attachment pin 6.

The locking pawl 35 extends from the rotary portion 32 in the shape of a hook. A hook-side U-shaped portion 35*a* which opens in the direction opposite to the U-shaped portion 26 in a state in which the locking pawl 35 closes the lock-side U-shaped portion 25 is provided on the side opposite to the U-shaped portion 26.

Since the hook-side U-shaped portion 35*a* engages with the attachment pin 6 inserted into the lock-side U-shaped portion 25 in the direction opposite to the U-shaped portion 26, the hook-side U-shaped portion 35*a* can firmly engage with the attachment pin 6 as compared with the case where the hook-side U-shaped portion 35*a* engages with the attachment pin 6 in the same direction as the U-shaped portion 26, for example.

As shown in FIG. 2A, the arm portion 36 has a bolt hole 37.

The bolt hole 37 is formed so that the bolt hole 37 coincides with a bolt hole 23*a* formed in the locking plate 23 in a state in which the locking pawl 35 closes the opening 25*a*. The rotary hook 30 can be secured to the locking plate 23 by fastening the securing bolt/nuts 39 through the bolt holes 37 and 23*a*.

The arm portion 36 has a tubular guide portion 38 into which an operation bar (second operation lever) 46 is inserted to rotationally move the rotary hook 30 as described later.

The attachment 5 is secured to the coupler 10 as follows. First, the securing bolt/nuts 39 are removed. The rotary hook 30 secured using the lock lever tool 40 is then released utilizing the operation bar 46. The rotary hook 30 is then rotationally moved to a position at which the rotary hook 30 opens the opening 25*a* of the lock-side U-shaped portion 25, and is again secured using the lock lever tool 40.

The attachment pins 6 and 7 are then inserted into the lock-side U-shaped portion 25 and the U-shaped portion 26, respectively. The rotary hook 30 secured using the lock lever tool 40 is again released utilizing the operation bar 46, and is rotationally moved so that the locking pawl 35 closes the opening 25*a* of the lock-side U-shaped portion 25. The arm portion 36 is then secured to the locking plate 23 with a bolt to secure the attachment pins 6 and 7 using the rotary hook 30 so that the attachment pins 6 and 7 are not removed.

The lock lever tool 40 has a locking protrusion 44 which is provided in a guide casing 42 and is biased by a spring 45 in the protruding direction. The locking protrusion protrudes toward the rotary portion 32.

As shown in FIG. 2B, the guide casing 42 is disposed to face the rotary portion 32 of the rotary hook 30 between the opposite mounting plates 21. The guide casing 42 is connected to each mounting plate 21 through a support portion 43 by means of bolted connection or the like.

The rotary portion 32 of the rotary hook 30 is provided with locking depressions 33 and 34 at such positions that the locking protrusion 44 faces the locking depression 33 or 34 when the rotary hook 30 is rotationally moved to open or close the opening 25*a* of the lock-side U-shaped portion 25.

The lock lever tool 40 secures the rotary hook 30 by the locking protrusion 44 which protrudes into and engages with the locking depression 33 or 34 of the rotary portion 32 at a position at which the rotary hook 30 opens or closes the opening 25*a* of the lock-side U-shaped portion 25.

An operation lever (first operation lever) 41 is connected to the locking protrusion 44. The operation lever 41 protrudes from the guide casing 42.

The lock lever tool 40 is formed so that the locking protrusion 44 can be withdrawn from the rotary hook 30 by raising the operation lever 41 away from the rotary hook 30, whereby engagement of the locking protrusion 44 with the locking depression 33 or 34 can be released.

Therefore, the rotary hook 30 secured using the lock lever 40 can be released by raising the operation lever 41 away from the rotary hook 30.

A method of detaching the attachment 5 by operating the rotary hook 30 using the operation bar 46 is described below.

FIGS. 4A to 4G are views illustrative of a state in which the attachment 5 is detached from the coupler 10 by rotationally moving the rotary hook 30 by operating the operation bar 46.

In FIGS. 4A to 4G, only the main portion around the rotary hook 30 is illustrated as the coupler 10, and only the attachment pin 6 which is caused to engage with the coupler 10 using the rotary hook 30 is illustrated as the attachment 5.

Figure 4A:
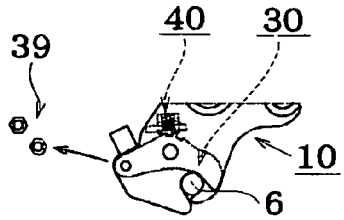
FIGS. 4A to 4G are views illustrative of a state in which an attachment is detached from a coupler by rotationally moving a rotary hook by operating an operation bar.

As shown in FIG. 4A, an operator (not shown) removes the securing bolt/nuts 39 so that the rotary hook 30 is secured using only the lock lever tool 40.

Figure 4B:
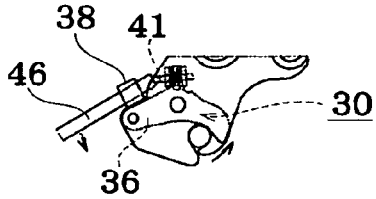

As shown in FIG. 4B, the operator holds the operation bar 46 and inserts the end of the operation bar 46 into the guide portion 38.

The guide portion 38 is disposed on the arm portion 36 of the rotary hook 30 so that the tubular guide direction faces the operation lever 41 of the lock lever tool 40.

Figure 5A:
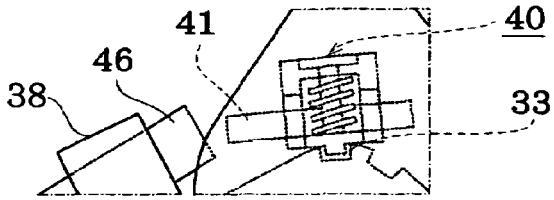
FIGS. 5A to 5E are enlarged views illustrative of a portion around a lock lever tool.
Figure 5B:
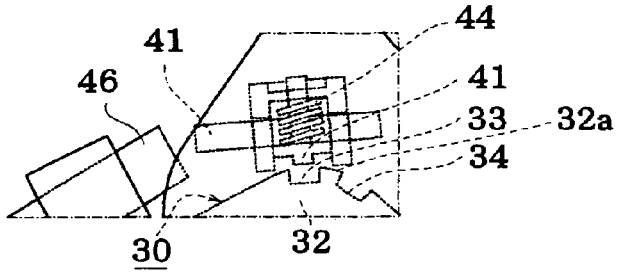

The operator inserts the end of the operation bar 46 into the guide portion 38, as shown in FIG. 5A, and withdraws the locking protrusion 44 from the locking depression 33 by raising the operation lever 41, as shown in FIG. 5B.

Figure 4C:
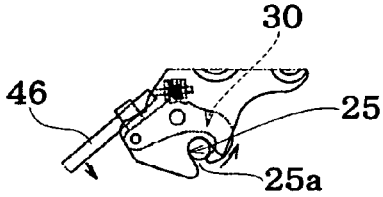

As shown in FIG. 4C, the operator rotates the operation bar 46 in a state in which the rotary hook 30 is released to rotationally move the rotary hook 30 by means of leverage.

The locking protrusion 44 slidingly contacts a periphery 32*a* of the rotary portion 32 when the rotary hook 30 rotationally moves. When the rotary hook 30 has rotationally moved to a position at which the rotary hook 30 completely opens the opening 25*a* of the lock-side U-shaped portion 25, the locking protrusion 44 faces the locking depression 34. The locking protrusion 44 then protrudes into the locking depression 34 due to the elastic biasing force of the spring 45 and engages with the locking depression 34.

Figure 4D:
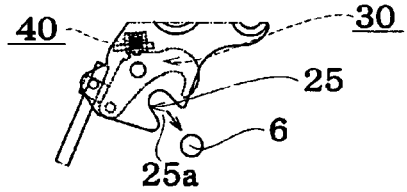
Figure 5C:
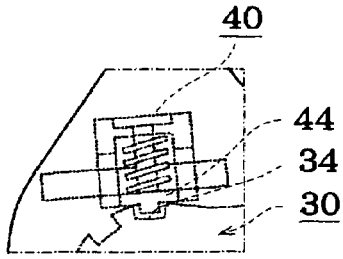

FIGS. 4D and 5C show a state in which the rotary hook 30 is rotationally moved to open the opening 25*a* of the lock-side U-shaped portion 25 so that the locking protrusion 44 protrudes into the locking depression 34 to secure the rotary hook 30 using the lock lever tool 40.

The operator operates the arm of the working machine to remove the attachment pin 6 from the opening 25*a* of the lock-side U-shaped portion 25 in an open state. The operator also removes the attachment pin 7 shown in FIG. 3A from the U-shaped portion 26 to remove the attachment from the coupler 10.

Figure 4E:
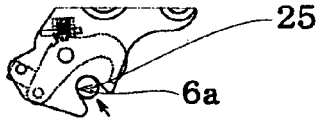

As shown in FIG. 4E, the operator inserts an attachment pin 6*a* of another attachment into the lock-side U-shaped portion 25.

Figure 4F:
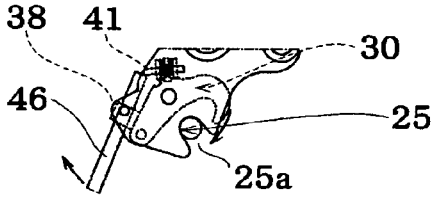
Figure 5D:
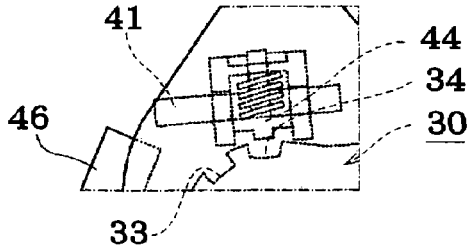

As shown in FIGS. 4F and 5D, the operator inserts the operation bar 46 into the guide portion 38, and rotationally moves the rotary hook 30 by operating the operation lever 41 in a state in which the locking protrusion 44 does not engage with the locking depression 34.

Figure 5E:
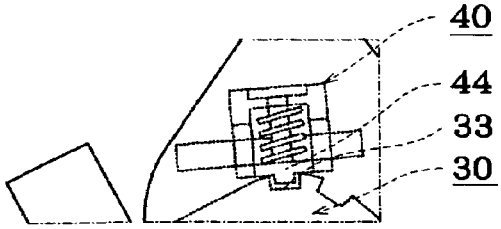

As shown in FIG. 5E, the locking protrusion 44 of the lock lever tool 40 engages with the locking depression 33 at a position at which the locking pawl 35 closes the opening 25*a* of the lock-side U-shaped portion 25, whereby the rotary hook 30 is secured.

Figure 4G:
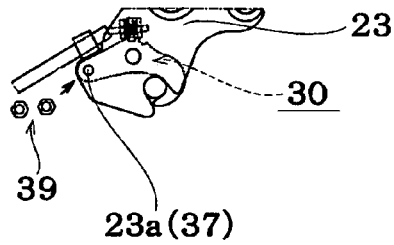

As shown in FIG. 4G, the position of the bolt hole 37 of the rotary hook 30 coincides with the position of the bolt hole 23*a* of the locking plate 23 in this state. The operator secures the rotary hook 30 and the locking plate 23 by fastening the securing bolt/nuts 39 through the bolt holes 37 and 23*a*.

Figure 6A:
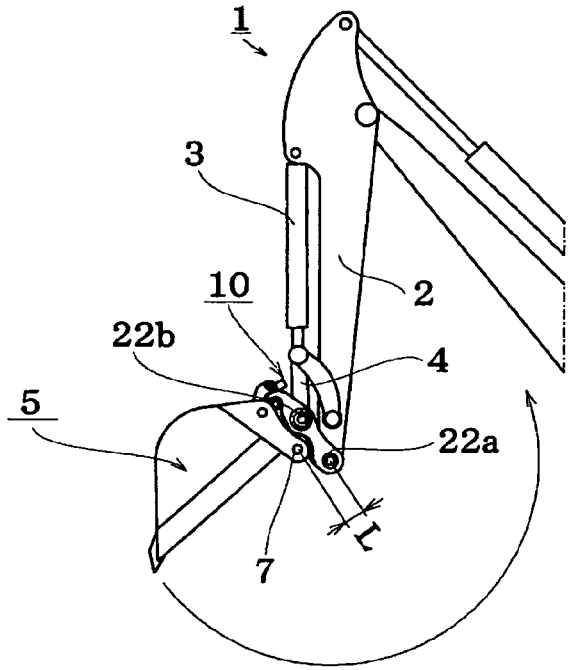
FIGS. 6A and 6B are views illustrative of a state in which a coupler is rotated.
Figure 6B:
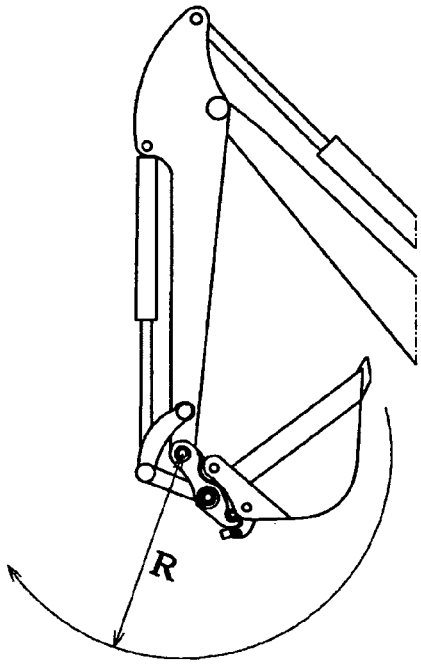

FIGS. 6A and 6B show a state in which the attachment (bucket) 5 is secured to the coupler 10 attached to the end of the arm 2 of the working machine, and the attachment 5 is rotated by driving a bucket cylinder 3.

The coupler 10 is attached to the arm 2 in a state in which the connection pin 22*a* is pivotally attached to the end of the arm 2 and the connection pin 22*b* is pivotally attached to the end of the bucket cylinder through the front link 4. As shown in FIGS. 6A and 6B, the coupler 10 swings around the connection pin 22*a* by driving the bucket cylinder 3 to rotate the attachment 5.

A space for receiving/driving a hydraulic cylinder need not be provided in the coupler, differing from related-art technology. Therefore, a length L from the connection pin 22*a* to the attachment pin 7 which engages with the U-shaped portion 26 shown in FIG. 1A in the swing radius direction of the attachment 5 can be reduced. As a result, an operation radius R of the attachment can be reduced by reducing the thickness of the coupler 10.

Although only some embodiments of the invention have been described in detail above, those skilled in the art would readily appreciate that many modifications are possible in the embodiments without materially departing from the novel teachings and advantages of the invention. Accordingly, such modifications are intended to be included within the scope of the invention.

What is claimed is:

1. An attachment coupler that is attached to an end of an arm of a working machine, an attachment having two attachment pins in parallel being detachably attached to the attachment coupler, the attachment coupler comprising: a pair of locking plates, each one of the locking plates comprising a first U-shaped portion that engages with and supports one of the two attachment pins sideways; and a second U-shaped portion that has an opening that opens downwardly, the other of the two attachment pins being received by the opening upwardly, a rotary hook rotatably supported between two second U-shaped portions of the locking plates and that opens and closes the opening of the second U-shaped portions;

the rotary hook including:

an engagement securing member that engages with and secures the rotary hook when the rotary hook closes the opening of the second U-shaped portion and when the rotary hook opens the opening of the second U-shaped portion; and a bolt securing member that secures the rotary hook with a bolt passing through aligned holes of the rotary hook and the locking plates when the rotary hook closes the opening of the second U-shaped portion, the engagement securing member including:

a lock level tool that is spring-biased to protrude toward the rotary hook; and locking depressions that are formed in the rotary hook, the lock level tool engaging with one of the locking depressions when the rotary hook closes the opening of the second U-shaped portion, and engaging with another one of the locking depressions when the rotary hook opens the opening of the second U-shaped portion.

2. The attachment coupler as defined in claim 1, the lock lever tool including a first operation lever that is used to release the engagement of the lock lever tool with the rotary hook against a spring biasing force of the lock lever tool;

the rotary hook including a guide portion, an end of a second operation lever that is used to rotationally move the rotary hook being inserted into the guide portion; and the rotary hook being rotationally moved by a vertical operation of the second operation lever while releasing the engagement of the lock lever tool with the rotary hook by inserting the end of the second operation lever into the guide portion and moving the second operation lever against the spring biasing force of the lock lever tool.

* * * * *